United States Patent [19]

Meindl

[11] Patent Number: 4,958,574

[45] Date of Patent: Sep. 25, 1990

[54] CABLE TRANSPORT SYSTEM WITH GARAGING OF CARRIERS

[75] Inventor: Bernd Meindl, Hard, Austria

[73] Assignee: Konrad Doppelmayr & Sohn Maschinenfabrik Gesellschaft M.B.H. & Co. KG, Wolfurt, Austria

[21] Appl. No.: 438,707

[22] Filed: Nov. 17, 1989

[30] Foreign Application Priority Data

Nov. 18, 1988 [AT] Austria ..... 2831/88

[51] Int. Cl.[5] ..... B61J 3/02; B61K 1/00

[52] U.S. Cl. ..... 104/88; 104/87; 104/91; 104/130; 104/164; 104/173.2

[58] Field of Search ..... 104/87, 88, 91, 93, 104/96, 103, 130, 132, 164, 173.1, 173.2, 180, 188; 198/465.4

[56] References Cited

U.S. PATENT DOCUMENTS

| | | | |
|---|---|---|---|
| 917,331 | 4/1909 | Magdiel et al. | 104/91 |
| 1,139,440 | 5/1915 | Perkins | 104/93 |
| 1,994,032 | 3/1935 | Angerpointer | 104/91 |
| 3,336,887 | 8/1967 | O'Donnell | 104/93 |
| 3,471,040 | 10/1969 | Field | 104/164 |
| 4,641,585 | 2/1987 | Torassoff | 104/173.2 |
| 4,699,064 | 10/1987 | Tarassoff | 104/173.2 |

*Primary Examiner*—Robert P. Olszewski
*Assistant Examiner*—Samuel Joseph Morano
*Attorney, Agent, or Firm*—Herbert Dubno

[57] ABSTRACT

A cable conveyance having a storage region for garaging the carriers which can be decoupled from the transport cable. The carriers are displaced along a transport rail to the storage regions by a reversible drive and are permitted to move by gravity along storage rails into this region or by positively tilting these storage rails back to the transport rail to return to the cable. Thus within the storage region the displacement of the carriers is by gravity only and there is no need to provide a special drive for entrainment of the carriers along the storage rails.

10 Claims, 4 Drawing Sheets

CABLE TRANSPORT SYSTEM WITH GARAGING OF CARRIERS

CROSS REFERENCE TO RELATED APPLICATION

This application is related to my copending application Ser. No. 07/389,425 filed Aug. 3, 1989 and relating to a cable conveyance of the type to which the instant invention is directed.

FIELD OF THE INVENTION

My present invention relates to a cable conveyance provided with facilities for the garaging or storage of the conveyance carriers, for example, cable conveyance chairs in the case of a chair-lift, gondolas in the case of a cable car or other cable conveyance cabins which can be coupled to or decoupled from the conveyance.

More particularly, the invention relates to a cable conveyance of the type in which the carriers are normally conducted along a guide rail and are entrained by a cable, e.g. between high altitude and low altitude stations and, at one of these stations, can be guided away from the cable to allow passengers to ascend to or descend from the carriers before the carriers are recoupled with the cable. Specifically the invention relates to a system for storing the carriers once they have been removed from the cable, e.g. at one of these stations.

BACKGROUND OF THE INVENTION

As has been pointed out in the above-identified application, cable conveyances for transporting people between a station at a relatively high altitude and a station at a lower altitude, e.g. between a hill or mountain station and a station at a lower point, e.g. in a valley, are widely used, for example, at ski slopes and in other areas in which the transport of people to mountain peak or from a mountain peak, for example, may prove to be desirable or advantageous.

Such cable conveyances generally comprise a transport cable extending endlessly around pulleys or wheels at the upper and lower stations, and a plurality of passenger-carrying vehicles, transporters or carriers which are suspended at spaced locations from the cable.

The "vehicles" or passenger carriers may be of diverse types. For example, they may be cabins, gondolas or cars, each of which is capable of carrying a number of passengers. They may be individual seats or chairs capable of carrying one or two passengers or they may be simply T-bars which entrain the carried passengers up a ski slope. For the purpose of this description, therefore, the devices which actually support the passengers to be transported will be referred to simply as carriers and the mechanisms by which the carriers are held on the cable as suspension devices.

With respect to the cable conveyance, insofar as the details thereof are necessary to an understanding of the instant application, the above-identified application is hereby incorporated in its entirely by reference.

At each of the stations or at least one of these stations, the cable conveyance can be provided with a transport rail along which the suspension devices are guided as the carriers are returned to the cable for movement between the station, and a circulating rail along which the carriers can be guided when the carriers are decoupled from the cable and are, for example, to be stopped or slowed to enable the passengers to mount or dismount. That rail may be referred to as a guide rail herein and transports the carriers from one side of the wheel or pulley to the opposite side thereof, i.e. from an arrival side of the cable to a departure side of the cable.

Upon termination of the operation of a cable conveyance of this type, it is frequently desirable to decouple the carriers, for example, the cabins or seats, from the cable and to guide the carriers via a transport rail into a predetermined region, especially an enclosed space, chamber or hall, in which the carrier can be garaged or stored at least until operation of the cable conveyance commences again.

This has the advantage that it protects the carriers against the effects of weather during periods in which the cable conveyance is inoperative. This has been found to be especially important for carriers like seats since otherwise it may be necessary in a highly time-consuming and inconvenient manner to clear the carrier from snow or ice before the carrier is recoupled to the cable.

Garaging is advantageous even for gondolas since experience has shown that gondolas left suspended from the cable during periods of inactivity of the conveyance can be damaged by the effects of wind and storms.

In prior art systems which allow for the garaging of the carriers, a branch is provided in the region of the transport cable over which the carrier is guided along a transport rail by means of a drive arrangement so that this drive arrangement engages, entrains or displaces each carrier substantially over its entire path from the cable conveyance to the storage chamber.

In the storage chamber a multiplicity of mutually parallel storage rails can be provided along which the carriers can be moved via curved rails. In general, over the entire paths of the carriers within the storage chamber, the storage rails must be associated with drive devices which can engage the carriers for such displacement and can be operated to deliver the carriers to the cable conveyance when recoupling is desired.

Because generally such drive systems are intended to operate in only one direction or sense, generally the storage chamber is supplied with the carriers from one side and the carriers are transported within the storage chamber to an opposite side from which they are ultimately returned to the cable conveyance via further curved transport rails and branches, i.e. switching rails or the like and, of course, the usual drive devices arrayed along these rails and branches.

Since the carriers must be coupled to the cable at locations which are determined by the single travel direction of the cable, two switch track arrangements are required in standard garaging systems so that the carriers are fed to the storage chamber via a first switch track and, with the cable operating in a single direction, the carriers are returned to the cable over a second switch track located downstream in this direction from the first switch track.

European patent document EU No. 125 967 B1 describes a cable conveyance with a rail for the movement of the carriers which is swingable to adjust the height of the carriers. This cable conveyance, however, does not provide a garaging for the carrier, nor does it suggest any relationship between this height adjustment and the garaging of the carriers.

OBJECTS OF THE INVENTION

It is, therefore, the principal object of the present invention to provide an improved cable conveyance with garaging of the carriers which can avoid drawbacks of earlier cable conveyances.

Another object of this invention is to provide an improved cable conveyance enabling the garaging or storage of the carriers which is of simplified construction, lower capital cost and higher reliability than existing garaging systems for carriers which can be decoupled from the conveyance.

SUMMARY OF THE INVENTION

These objects and others which will become apparent hereinafter are attained, in accordance with the present invention by providing in a cable conveyance of the aforedescribed type and, especially, in a cable conveyance of the type described in my above-mentioned copending application, a storage region which can be located in the vicinity of one of these stations which is provided with at least on storage rail swingable about a horizontal axis between two oppositely inclined positions. In a first-inclined position of this storage rail, the storage rail is inclined downwardly away from the cable conveyance and the carriers by gravity can ride downwardly along this rail upon decoupling from the cable for storage and without any need for drive entrainment of the carriers.

In the second position, in which the rail is inclined downwardly from the cable conveyance, the carriers can ride solely by gravity toward the cable conveyance for recoupling to the cable which, according to the invention is reversible in its direction of movement to allow recoupling of the carriers to the cable during movement of the cable in a direction opposite that in which the cable moves for decoupling and garaging of the carriers.

Means is provided, according to the invention, for swinging the rail or each or all of these storage rails, between the two positions described. Advantageously, the storage region is a closed chamber protecting the carriers from the weather.

According to the invention, therefore, the carriers which are to be stored in the storage chamber are detached from the cable as the latter is displaced in a direction opposite its normal direction of displacement for cable conveyance travel, guided along the transport rail via a branch track to the rail or rails of the storage chamber and by lowering of the ends of these storage rails remote from the branch track or transport rail, are caused to pass solely by gravitational force downwardly along the storage rail for storage thereon.

The number of carriers which can be stored will, of course, depend upon the length of the or each storage rail and the number of mutually parallel storage rails since each can store a multiplicity of carriers.

When the carriers are to be recoupled to the transport cable, the ends of the storage rails remote from the transport rail can be raised so that the carriers can, by gravity, move in the opposite direction along the storage rails and can pass again along the transport rail.

Since the drive of the cable has been reversed again, the carriers can be coupled in succession to the cable as the latter is displaced in its normal transport direction.

The carriers are connected to the cable with the requisite spacing between them and are thereafter advanced by the cable along the closed cable transport path.

With the device of the invention there is no need for a drive mechanism or arrangement within the storage chamber for the carriers on the rails since, within the storage chamber, the carriers are displaced in either direction only by the effect of gravity.

In an apparatus with D preferably parallel storage rails in the storage chamber, each of the storage rails can be closed at its end remote from the transport rail and each 1 to (n−1) storage rail can be connected to the transport rail by one and the same branch track.

The cable conveyance of the invention thus can comprise:

a cable transporter having a transport cable, guide means for defining a path for the cable, drive means for displacing the cable, a plurality of carriers couplable to and decouplable from the cable, and a guide rail receiving carriers decoupled from the cable for disembarking and boarding of passengers and returning decoupled carriers to the cable for recoupling thereto; and means for garaging of the carriers, the means for garaging of the carriers including:

means forming a storage region for receiving carriers to be garaged, a transport rail between the guide rail and the region and a drive associated with the transport rail for advancing carriers from the guide rail to the region, at least one storage rail in the region having an end turned toward the transport rail and receiving the carriers therefrom and an opposite end remote from the transport rail, means for mounting the storage rail to enable it to swing about a substantially horizontal axis between a position in which the storage rail is inclined downwardly away from the transport rail and the carriers move onto the storage rail by gravity and a position in which the storage rail is inclined downwardly toward the transport rail and the carriers move toward the transport rail by gravity, and means connected with the drive for reversing same to advance carriers from the storage rail to the guide rail along the transport rail.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
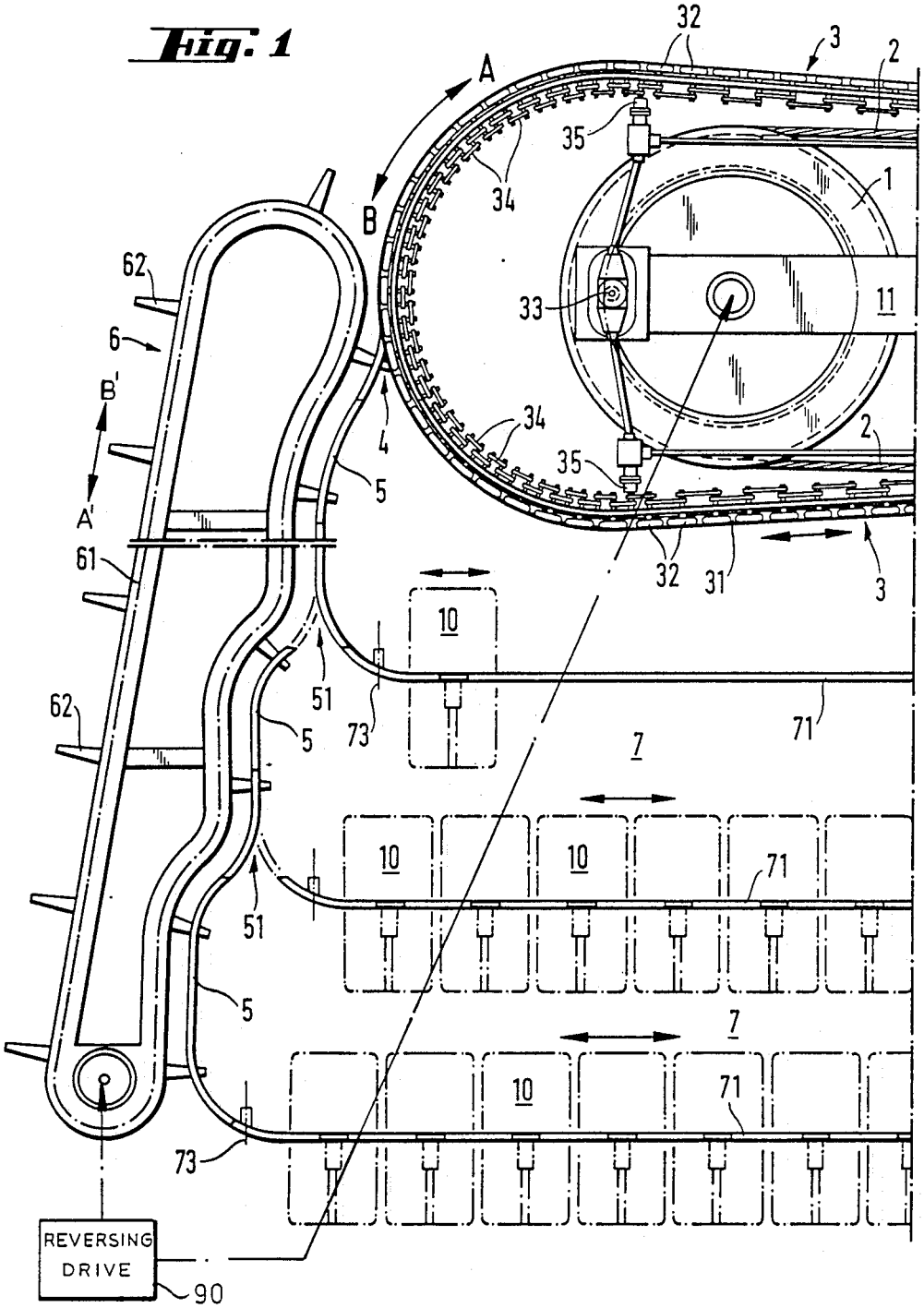
FIG. 1 is a plan view of a portion of a cable conveyance according to the invention provided with means for garaging the carriers.
Figure 3:
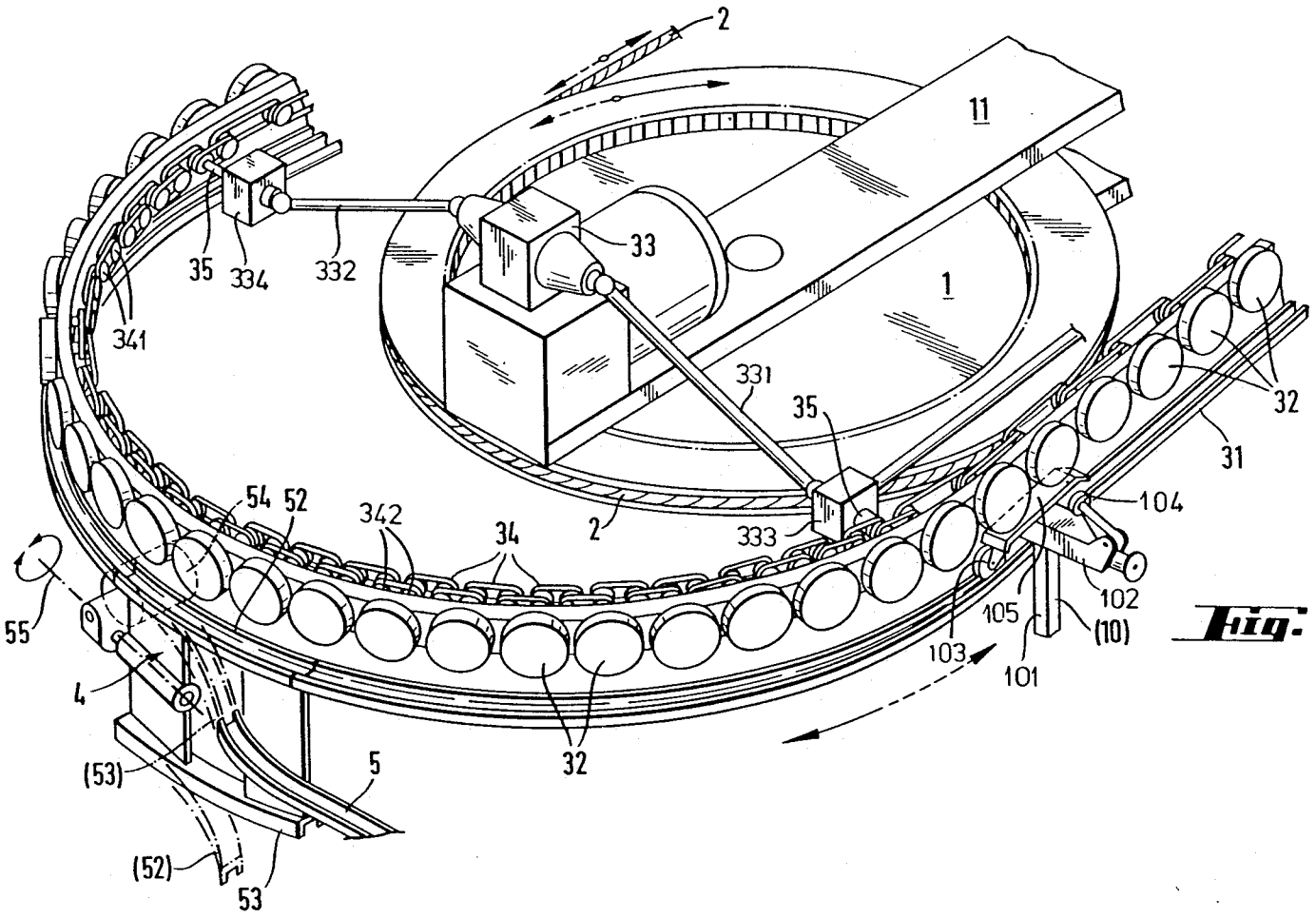
FIG. 3 is a perspective view of one of the cable-reversing wheels and a branching track associated therewith.

In FIGS. 1 and 3, one of the two cable deflection wheels 1 of a cable conveyance has been illustrated, the cable conveyance being, for example, of the type described in the above-identified application. Such a wheel is provided at each end of the elongated cable path and at, for example, the mountain station and the valley station. The endless cable 2, although referred to as a transport cable, passes around these wheels and can be supported at spaced locations between the station by pylons (not shown).

The cable-reversing wheel 1 is supported on a framework 11 which may form part of or can be connected to a housing structure which can support the rails and other stationary structures of the conveyance.

Externally of the wheel 1 and as also described in the above-identified application, a guide 3 is provided for the carriers 10 which are decoupled from the cable 1.

Figure 2:
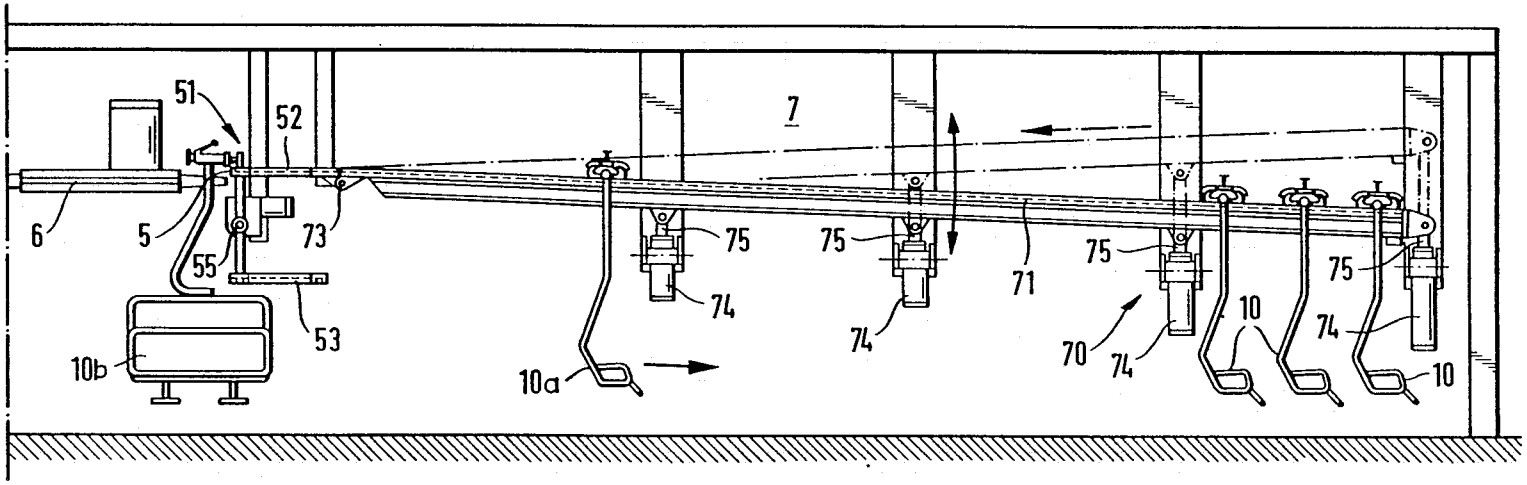
FIG. 2 is a side elevational view of the device of the apparatus of FIG. 1.

The carriers 10 are here shown at seats of a chair lift as illustrated at 10*a* in FIG. 2 or as gondolas 10*b*. The reference character 10, however, is used to designate generically any carrier which may be suspended from the conveyance.

The carriers 10 may, for example, have posts 101 extending downwardly from carriages 102 having riding wheels 103 and lateral guide wheels 14. The carriages 102 can, moreover, be provided with surfaces 105 which can be frictionally engaged by drive wheels.

The guide 3 comprises a guide rail 31 which extends substantially from a semicircle around the wheel 1 and then merges with linear extensions of this rail. The wheels 103 can ride in the rail 31.

Juxtaposed with the rail 31 ar drive wheels 32 engageable with the surfaces 105 of the carriages 102.

For control operation of the wheels 32, a drive 33 is provided (see the aforementioned application) which is coupled by two universal joint shafts 331 and 332 with torque distributing transmissions 333 and 334 driving the shafts 35 connected to respective wheels 32. The wheels 32, in turn, are connected together by V-belts 34 bridged between V-belt pulleys 341 or 342.

By a stepped-down or step-up V-belt transmission in the coupling of the wheels together, the wheels 32 can be driven with progressively smaller peripheral speeds as the carriers 10 enter the station so that carriers can be slowed down to permit passengers to disembark and other passengers to board. In the region of disembarking and boarding, the carriers can be displaced on a relatively low constant speed whereupon, by appropriate dimensioning of the V-belt transmission, the carriers can be accelerated to the speed of the cable 2 at which the carriers are reconnected to the cable.

The principles of this operation will be apparent from the aforementioned copending application and are not developed in greater detail herein because they are not necessary for an understanding of the present invention.

The guide 3 is provided with a branch track 4 via which the carrier 10 can be delivered to a guide rail 5 by means of a displacement arrangement 6 for ultimate delivery to a storage region generally represented at 7 and preferably consisting of an enclosed storage space or chamber.

The transport rail 5 has a plurality of branches 51 which, in number, is determined by the number of parallel storage rails 71 provided in the storage chamber 7. As a practical matter, for n rails 71 as illustrated in FIG. 1 ($n=3$) there are $n-1$ branches 51 ($n-1=2$ in FIG. 1). Using these branches, the seats 10 can be delivered by the drive device 6 to the individual storage rails 71.

Advantageously, the drive device 6 comprises an endless chain 61 having a stretch extending along the transport rail 5 and formed with fingers or arms 62 projecting from the chain and engageable with the carriers for entraining same.

When the chairs 10 are to be fed from the cable 2 to the storage chamber 7, the direction of the cable 2 is reversed from the direction A, i.e. the normal transport direction to the direction B and the transport conveyor 6 is driven in the clockwise sense as shown in FIG. 1. The carriers 10 are then diverted from the guide 3 by the branch track 4 to the transport rail 5 and from the latter are entrained by the conveyor 6 via the branches 51 to the storage chamber 7. The movement of the seats 10 within the storage chamber is effected in the manner described hereinafter with reference to the apparatus as illustrated in FIG. 2.

As can be seen from FIG. 2, the individual rails 71 are swingably mounted at hinge joints 73 about substantially horizontal axes and at their ends proximal to the transport rail 5.

To swing each storage rail 71 about its respective horizontal axis, positioning devices 70 are provided. These devices can include fluid-operated cylinders 74 and respective pistons 75 which can be articulated to the ends of the storage rail 71 remote from their respective pivot joints 73.

Using these positioning devices, the storage rail 71 can be brought into different inclined orientations as represented, for example, in solid lines and in dot-dash lines in FIG. 2.

When the free end of the storage rail 71 is lowered below its pivot 73, the rail 71 is inclined downwardly away form the transport rail 5 and the chair conveyors 10 can move solely by gravitational force along the storage rail 71 toward the free end thereof.

When, however, the actuator 74, 75 raises the free ends of the rail above the corresponding horizontal pivot 73, the storage rail 71 is inclined downwardly toward the transport rail 5 and the carriers 10 move in the direction thereof by gravity. This construction, of course, eliminates any need for a displacement device within the storage chamber 7 or along the storage rail 71 for entraining the carriers.

FIG. 3 shows the wheel 1, the drive and guide mechanism 31-35 for the chair carriers 10 decoupled from the cable, the branch 4 and the transport rail 5 to an enlarged scale.

Figure 4:
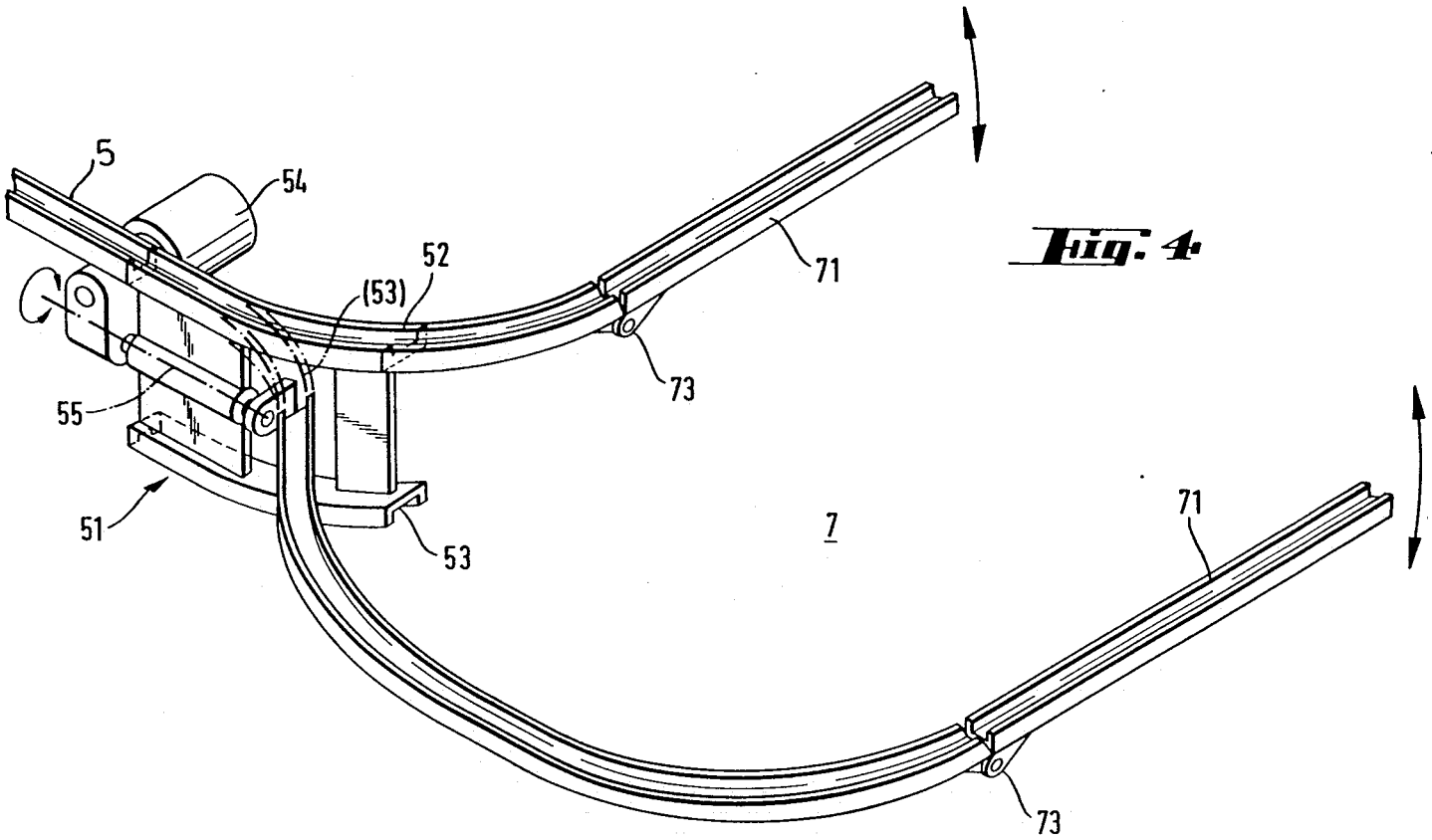
FIG. 4 is an enlarged perspective view of a branch-track arrangement in accordance with the principles of the invention.

In FIG. 4 a branch track 51 and two storage rails 71 associated therewith and located in the storage region, have been illustrated in a perspective view. As can be seen from this Figure, the branch 51 can be formed by two vertically spaced rail segments 52 and 53 which can be brought into respective positions shown in solid lines and dot-dash lines by rotation about a horizontal axis 55 by the rotary actuator 54. As a consequence, one or the other of the two rails 71 can be connected to the transport rail 5 to allow the carriers to be fed in succession to first one of the storage rails 71 and then to the other storage rail 71 or, conversely, to be fed in succession back to the transport rail 5 from one or the other of the rails 71, in accordance with the inclination imparted to each storage rail 71 in the manner already described. The branch track 4 can have a similar or identical construction.

The apparatus illustrated in the drawing operates as follows:

When the chairs 10 are to be moved into the storage chamber 7 for garaging, the drive of the wheel 1 (and hence the cable 2) is reversed by a drive-reversing unit shown at 90 in FIG. 1, thereby also reversing the drive wheels 32 of the guide 3 and the direction of movement of the chairs 10 from the direction A to the direction B.

As the chairs 10 are moved in the direction B and are decoupled from the cable 2, they are guided via the branch 4. The control 90 drives the conveyor 6 in its clockwise sense (arrow B') to entrain the seats via the branch tracks 51 to one of the storage rails 71.

The storage rails 71 are here inclined downwardly away from the transport rail 5. When one of the storage rails 71 is filled with the seats 10, the branch 51 immediately upstream thereof switches over to enable the next storage rail 71 to be filled. The process is repeated until all of the carriers 10 have been removed from the cable 2 and stored in the region 7 or there is no longer any storage space available. The cable conveyance can then be shut down.

When the cable conveyance is again set into operation, the actuator 74, 75 raises the rail 71 in succession as the branches 51 connect each storage rail 71 to the transport rail 5. The controller 90 reverses the conveyor 6 so that it is now driven in the counterclockwise sense represented by arrow A and whereas the cable 2 and the wheel 1 are driven in the direction of arrow A and the seats 10 are recoupled to the cable 2. Of course, instead of seats, the carriers may be cabins or any other type of vehicle or conveyance conveniently suspended from a cable conveyance of the type described.

I claim:

1. A cable conveyance, comprising:

a cable transporter having a transport cable, guide means for defining a path for said cable, drive means for displacing said cable, a plurality of carriers couplable to and decouplable from said cable, and a guide rail receiving carriers decoupled from said cable for disembarking and boarding of passengers and returning decoupled carriers to said cable for recoupling thereto; and means for garaging of said carriers, said means for garaging of said carriers including:

means forming a storage region for receiving carriers to be garaged, a transport rail between said guide rail and said region and a drive associated with said transport rail for advancing carriers from said guide rail to said region, at least one storage rail in said region having an end turned toward said transport rail and receiving said carriers therefrom and an opposite end remote from said transport rail, means for mounting said storage rail to enable it to swing about a substantially horizontal axis between a position in which said storage rail is inclined downwardly away from said transport rail and said carriers move onto said storage rail by gravity and a position in which said storage rail is inclined downwardly toward said transport rail and said carriers move toward said transport rail by gravity, and means connected with said drive for reversing same to advance carriers from said storage rail to said guide rail along said transport rail.

2. The cable conveyance defined in claim 1 wherein said storage region is provided with a plurality of storage rails and for n storage rails in said region, from 1 to n−1 branches are provided to selectively connect said storage rails to said transport rail.

3. The cable conveyance defined in claim 2, further comprising a respective actuator connected to each of said storage rails at said opposite end thereof remote from said transport rail for shifting said storage rail between said positions.

4. The cable conveyance defined in claim 3 wherein each of said actuators includes a fluid-operated cylinder and a piston articulated to the respective storage rail.

5. The cable conveyance defined in claim 4 wherein said means for mounting includes means forming a hinge joint having a substantially horizontal axis for the respective end of each of said storage rails turned toward said transport rail.

6. The cable conveyance defined in claim 5 wherein said drive is a conveyor chain having entrainment fingers projecting therefrom and displaceable along said transport rail for engagement with said carriers.

7. The cable conveyance defined in claim 6 wherein said means connected with said drive is operatively connected with said drive means for displacing said cable for reversing the direction of said cable substantially contemporaneously with reversing a direction of displacement of said drive.

8. The cable conveyance defined in claim 7 wherein each of said branches includes a device having a pair of branch tracks rotatable about an axis and selectively alignable with respective ones of said storage rails.

9. The cable conveyance defined in claim 8 wherein said chairs and said cable conveyance is a chair lift.

10. The cable conveyance defined in claim 8 wherein said cars and said cable conveyance is a cable car apparatus.

* * * * *